US006058537A

United States Patent [19]

Larson

[11] Patent Number: 6,058,537

[45] Date of Patent: May 9, 2000

[54] PRESSURE CONTROL APPARATUS FOR AIR MATTRESSES

[76] Inventor: Lynn D. Larson, 5410 NW. 44th St., Lincoln, Nebr. 68524

[21] Appl. No.: 09/114,798

[22] Filed: Jul. 13, 1998

[51] Int. Cl.[7] ..... A47C 27/08; A47C 27/10

[52] U.S. Cl. ..... 5/710; 5/713

[58] Field of Search ..... 5/713, 706, 708, 5/710, 935; 236/1 RF, 51

[56] References Cited

U.S. PATENT DOCUMENTS

| | | | |
|---|---|---|---|
| 4,220,848 | 9/1980 | McMullan et al. | 219/528 |
| 4,292,701 | 10/1981 | Woychick | 5/422 |
| 4,352,976 | 10/1982 | McMullan | 219/217 |
| 4,798,936 | 1/1989 | Johnson, Sr. | 219/217 |
| 4,814,583 | 3/1989 | Rainey | 219/494 |
| 5,745,942 | 5/1998 | Wilkerson | 5/713 X |
| 5,815,864 | 10/1998 | Sloop | 5/706 |
| 5,873,137 | 2/1999 | Yavets-Chen | 5/713 |

FOREIGN PATENT DOCUMENTS

| | | | |
|---|---|---|---|
| 0041206 | 3/1982 | Japan | 236/1 R |

OTHER PUBLICATIONS

Magazine Advertisement for "Select Comfort Air Sleep Systems™", Spring 1995.

Magazine Advertisement for Select Comfort Corporation, Undated.

Brochure for AquaQueen, Undated.

AquaQueen Waterbed Heating Systems "Fact Book", Undated.

Aqua Queen "Standard Waterbed Heater Owner's Manual", Undated.

Landmark Installation Instructions for "Premium Waterbed Heating System", Undated.

*Primary Examiner*—William Wayner

*Attorney, Agent, or Firm*—Zarley, McKee, Thomte Voorhees & Sease; Dennis L. Thomte

[57] ABSTRACT

A pressure control apparatus includes an air pump which is pneumatically connected to an air mattress, with an air pressure sensor in the mattress for detecting the current air pressure within the mattress. A central control unit is interconnected with the pressure sensor and the air pump and is programmable to add or remove air from the mattress to control the pressure within the mattress. A plurality of position sensors in the mattress will detect the posture and/or position of an occupant of the bed and transmit this information to the control unit. The control unit can then determine the actual position of the occupant and adjust the air pressure within the air mattress accordingly.

4 Claims, 1 Drawing Sheet

PRESSURE CONTROL APPARATUS FOR AIR MATTRESSES

TECHNICAL FIELD

The present invention relates generally to air mattresses, and more particularly to a pressure control apparatus and control unit capable of varying the pressure in regions of the mattress according to time, or other parameters.

BACKGROUND OF THE INVENTION

People have different preferences for the "feel" of a mattress, varying from very firm to very soft. These preferences may differ from the level of support that would provide the best sleep posture. An occupant sitting in a bed would require a different softness or firmness for comfort and correct support that would an occupant lying prone or on one side. In addition, the correct firmness would vary depending upon the particular occupant using the bed.

SUMMARY OF THE INVENTION

The pressure control apparatus of the present invention includes an air pump which is pneumatically connected to an air mattress, with an air pressure sensor in the mattress for detecting the current air pressure within the mattress. A central control unit is interconnected with the pressure sensor and the air pump and is programmable to add or remove air from the mattress to control the pressure within the mattress. A plurality of position sensors in the mattress will detect the posture and/or position of an occupant of the bed and transmit this information to the control unit. The control unit can then determine the actual position of the occupant and adjust the air pressure within the air mattress accordingly.

It is therefore a general object of the present invention to provide an improved pressure control apparatus for an air mattress.

Another object is to provide a pressure control apparatus which will adjust the pressure within an air mattress dependent upon the position or posture of an occupant of the bed.

Still another object is to provide a pressure control apparatus which is interconnected with a position/posture sensor in the mattress and a control unit with a central processing capability.

These and other objects of the present invention will be apparent to those skilled in the art.

DESCRIPTION OF THE PREFERRED EMBODIMENT

Figure 1:
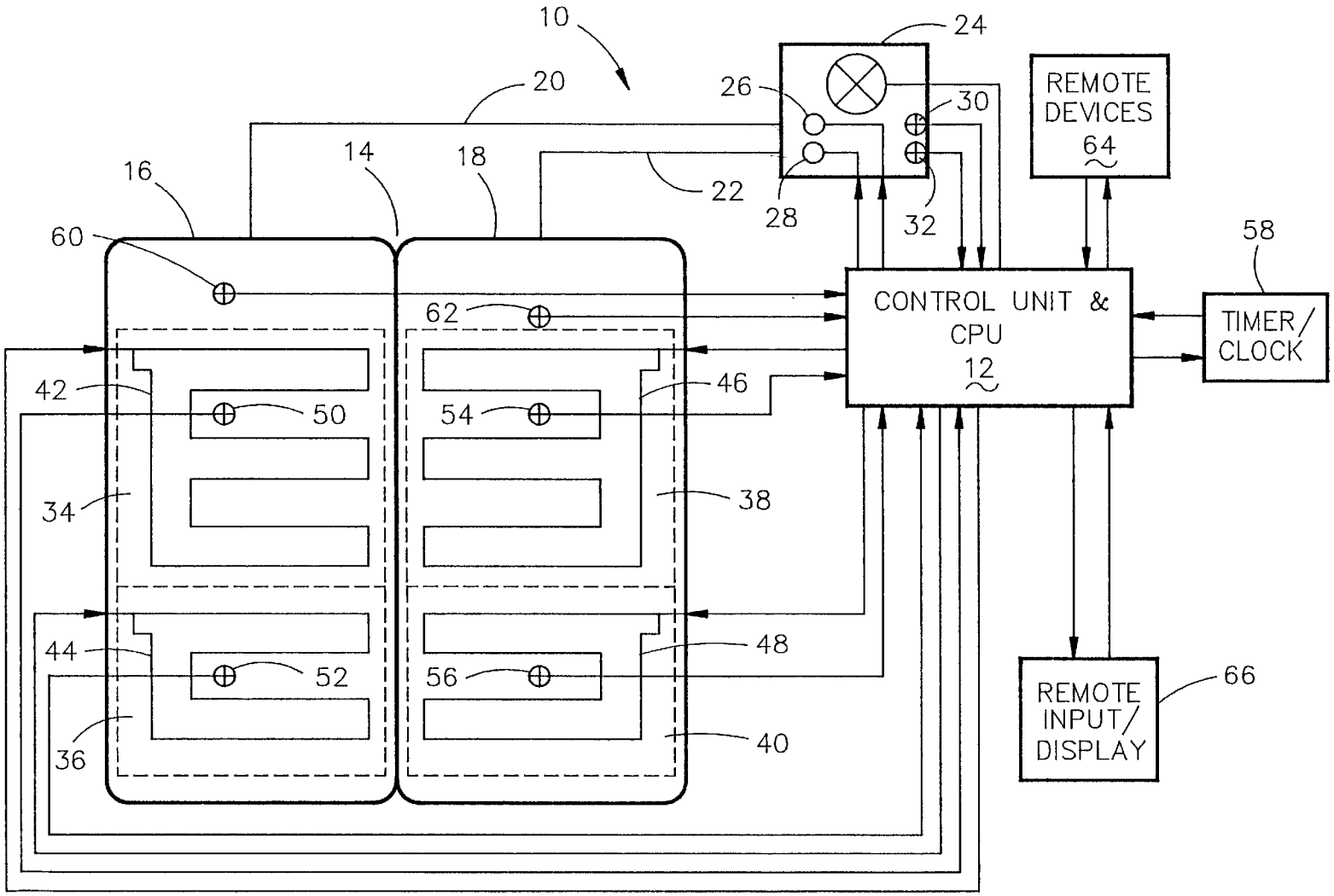
FIG. 1 is schematic diagram showing the interconnection of various sensors on an air bed with a control unit.

Referring now to the drawing, the pressure control apparatus of the present invention is designated generally at 10 and includes a control unit 12 having a central processing unit (CPU) therein for receiving, transmitting, and processing information.

Pressure control apparatus 10 is utilized to control the air pressure of an air filled mattress 14. Mattress 14 is divided into left and right independent bladders 16 and 18, each bladder designed to support an individual occupant. Each bladder 16 and 18 includes a pneumatic line 20 and 22 respectively connected to an air pump 24 via valves 26 and 28 respectively. In addition, control unit 12 will transmit control signals to air pump 24 and valves 26 and 28 to selectively open and close the valves, and to selectively operate the air pump to increase air pressure in one or both of bladders 16 and 18. In addition, each air bladder 16 and 18 includes a relief valve 30 and 32 respectively which are interconnected with control unit 12 for selective operation by the control unit. Thus, control unit 12 may either increase the pressure within bladder 16 and 18, or decrease the air pressure within bladder 16 and 18. Pressure sensors 34 and 36 in air bladders 16 and 18 are connected to control units 12, and transmit data regarding the pressure of air within each bladder 16 and 18.

Each bladder 16 and 18 is provided with a plurality of sensors 38 and 40, respectively, which transmit information to the CPU of control unit 12 to detect the presence and/or absence of an occupant, and to more specifically determine the posture and/or position of an occupant of each bladder 16 and 18. Possible sensors which may be utilized would include ultrasonic sensors, temperature sensors, capacitive sensors, infrared sensors, motion sensors, mechanical switches, localized pressure sensors, or strain gauges. Sensors 38 and 40 are located throughout the mattress to detect various portions of the human body and the extent to which the body presses down on the upper surface of the mattress. Once supplied with this information, the CPU of control unit 12 is capable of determining whether an occupant is sitting on the bed, lying prone, lying on one side, or in some other particular position on the bed. The CPU also makes it possible for the control unit to specifically adjust the pressure within each bladder 16 and 18, dependent upon the particular position or posture of the occupant. A person sitting up in a bed may prefer a firmer mattress for correct support and posture, while an individual lying down on the bed requires different air pressure settings for the bladder. The settings can be preprogrammed within control unit 12 for automatic adjustment of the pressure of the mattress dependent solely upon the position or posture of the occupant of the bladder.

While bed 14 is shown with only two air bladders 16 and 18, it would be possible to further refine the mattress with a multitude of individual independently controlled bladders, to more specifically define the shape and support of the mattress dependent upon the occupant's position or posture. Thus, if additional lumbar support is needed in one particular position, the individual air bladders within mattress 14 which support this region of the body could be inflated to a greater pressure than surrounding bladders.

A timer/clock 42 is interconnected to the control unit 12 and permits each occupant to set a timed delay for increasing or decreasing pressure of the particular bladder 16 or 18, whether for initial entry into the bed, or to assist the occupant in awakening in the morning. The interconnection of clock 42 with control unit 12 would also permit the CPU to measure actual changes in pressure over a period of time, and then calculate a compensating value.

The clock 42 would also permit the air pump 24 to be activated while an occupant is away from the bed, to avoid waking the occupant with air pump noise.

Various remote devices 44 may be interconnected with control unit 12, either directly or by transceivers or the like, to permit control of a wide variety of apparatus by control unit 12. For example, control unit 12 could be utilized to activate or deactivate a television, a radio, lights, security or alarms, household heat and cooling systems, dishwashers or the like. These devices could be set to either activate upon an occupant being detected on bed 14, or to activate upon detection of an occupant leaving bed 14. The CPU in control unit 12 could also be utilized to track use patterns of the occupant and set appliances and other apparatus accordingly. More specifically, when an occupant goes to bed, the control unit 12 could be programmed to start dishwasher, start the television 30 minute timer, set back the bed temperature, arm a security alarm, lower the temperature of the house or a room heating system, set an alarm clock, set a telephone to "no ring", switch the house lights to predetermined on/off patterns, or other similar activities. When the occupant arises, the alarm clock can be turned off, the television turned on, the coffee stirred, the lights turned on or off, etc., by control unit 12. In fact, control unit 12 could activate an air pump when the occupants are detected as leaving the bed, to inflate chambers in a special pillow top assembly which causes the pillow top assembly to extend to its full dimensions, thereby facilitating "making" the bed.

Finally, a remote input display unit 46 is interconnected with control unit 12 to permit the programming of the control unit from any remote location, as well as to display the current settings and conditions of devices controlled by control unit 12.

Whereas the invention has been shown and described in connection with the preferred embodiment thereof, many modifications, substitutions and additions may be made which are within the intended broad scope of the appended claims.

I claim:

1. A pressure control apparatus for controlling the air pressure within an air mattress of a bed, comprising:

an air pump pneumatically connected to the mattress by an inlet valve that selectively provides air to the mattress, but prevents air from escaping thereghrough;

a first air pressure sensor for sensing the air pressure within the mattress;

control means having a central processing unit operatively connected to said first air pressure sensor and said air pump for receiving air pressure information from said first air pressure sensor and for selectively operating said air pump for changing the air pressure within the mattress;

said mattress including an operable relief valve connected to the control means, and the control means being programmed to selectively open the relief valve to reduce pressure in the mattress to a predetermined level; and an occupant sensor in the mattress connected to the control means for detecting a presence and absence of a person on an upper surface of the mattress and transmitting information regarding the presence and absence of a person to the control means;

said occupant sensor further comprising a plurality of position sensors independent of said air pressure sensor arranged on the mattress to detect the position of an occupant on the mattress, said position sensors connected to the control means and operable to transmit position information thereto, said control means programmed to process the position information and determine the posture or position of an occupant on the mattress.

2. The apparatus of claim 1, wherein the control means is programmed to adjust the air pressure in the mattress based upon the posture/position of an occupant on the mattress.

3. The apparatus of claim 2, wherein the control means is in operable communication with remote devices, for selectively activating and deactivating the remote devices in response to information transmitted from the posture/position sensors.

4. The apparatus of claim 2, further comprising a timer connected with the control means, and wherein the control unit is programmed to change the pressure in the mattress at a predetermined time.

* * * * *